United States Patent [19]

Bacon

[11] 4,068,465

[45] Jan. 17, 1978

[54] CLOCK USING ALTERNATING CURRENT CYCLE COUNTING

[75] Inventor: David C. Bacon, Clarkston, Mich.

[73] Assignee: Bernard M. Licata, St. Clair Shores, Mich.

[21] Appl. No.: 595,567

[22] Filed: July 14, 1975

[51] Int. Cl.[2] ..... G04B 19/30

[52] U.S. Cl. ..... 58/50 R; 58/85.5; 58/127 R

[58] Field of Search ..... 58/23 R, 23 AC, 24 R, 58/24 A, 50 R, 127 R, 85.5

[56] References Cited

U.S. PATENT DOCUMENTS

| | | | |
|---|---|---|---|
| 3,691,752 | 9/1972 | Whittier | 58/50 R |
| 3,775,964 | 12/1973 | Fukumoto | 58/50 R |
| 3,823,551 | 7/1974 | Riehl | 58/50 R |
| 3,881,310 | 5/1975 | Gerun et al. | 58/23 BA |
| 3,889,459 | 6/1975 | Lu | 58/23 AC |
| 3,902,311 | 9/1975 | Cacow et al. | 58/23 AC |

*Primary Examiner*—Robert K. Schaefer
*Assistant Examiner*—Vit W. Miska
*Attorney, Agent, or Firm*—William L. Fisher

[57] ABSTRACT

In a method of keeping time by counting the cycles of an alternating current source and providing both alternating and direct current power from the alternating current source, the direct current power including a variable display voltage for illuminating the lights, displaying time using a plurality of lights and windows corresponding to the lights, generating signals from the alternating current source, counting and dividing the signals, decoding the counted and divided signals, and lighting the lights and windows in accordance with the decoding to display the time of day, and correcting, when necessary, the time displayed by the clock, the improvement comprising providing a plurality of electrical switches corresponding to the lights, the correcting being accomplished by actuating one of the switches, completing an electrical circuit upon such actuation of the switch and comparing the display voltage with the voltage applied to the light whose corresponding switch is actuated, the comparing being operative, whenever the compared voltages are unequal, to alter the counting to correct the time displayed by the clock.

14 Claims, 13 Drawing Figures

CLOCK USING ALTERNATING CURRENT CYCLE COUNTING

My invention relates to clocks.

The principal object of my invention is to provide improvements in clocks and in method of keeping and displaying time.

The foregoing object of my invention and the advantages thereof will become apparent during the course of the following description, taken in conjunction with the accompanying drawings, in which.

Figure 6:
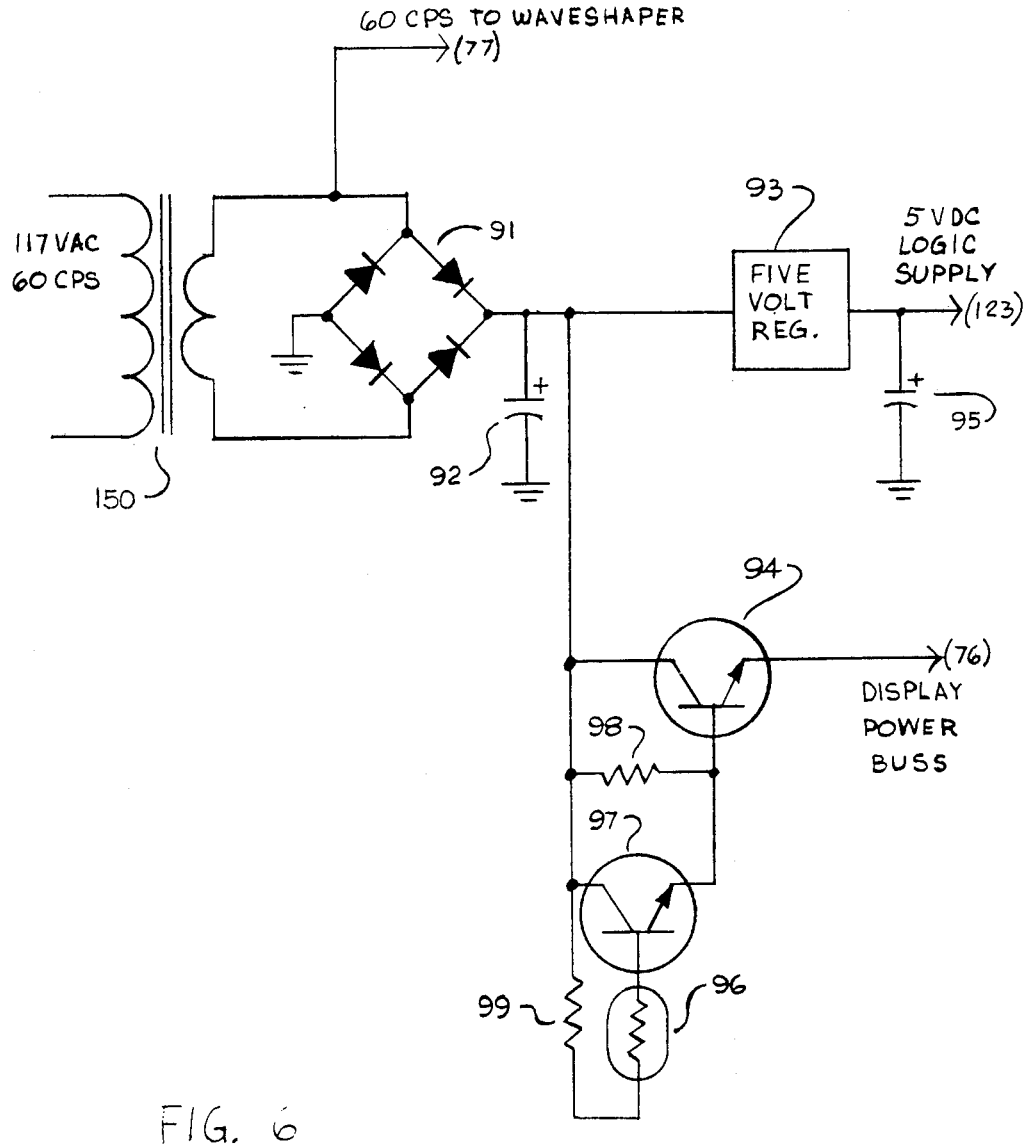
FIG. 6 is a schematic diagram of power supplies used in said clock.
Figure 9:
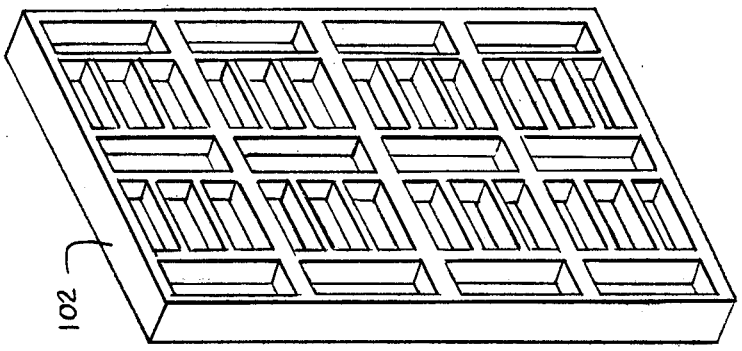
FIGS. 7–9 are perspective views, respectively, of a portion of a printed circuit board, windows and frame used in said clock.
Figure 8:
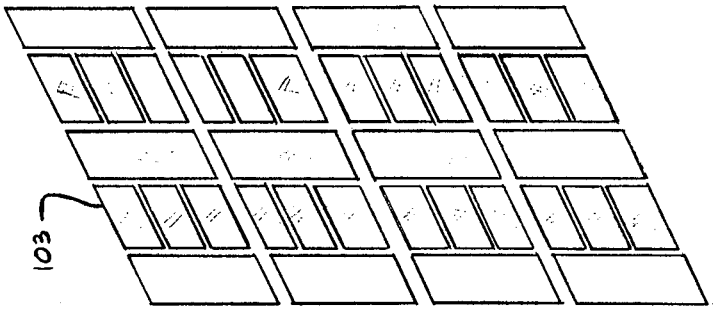
Figure 7:
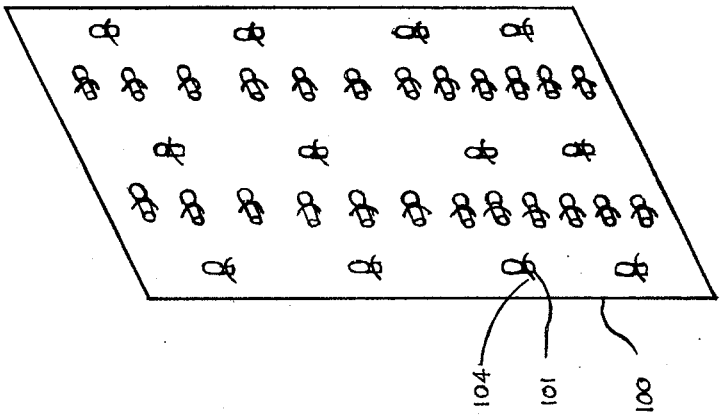
Figure 10:
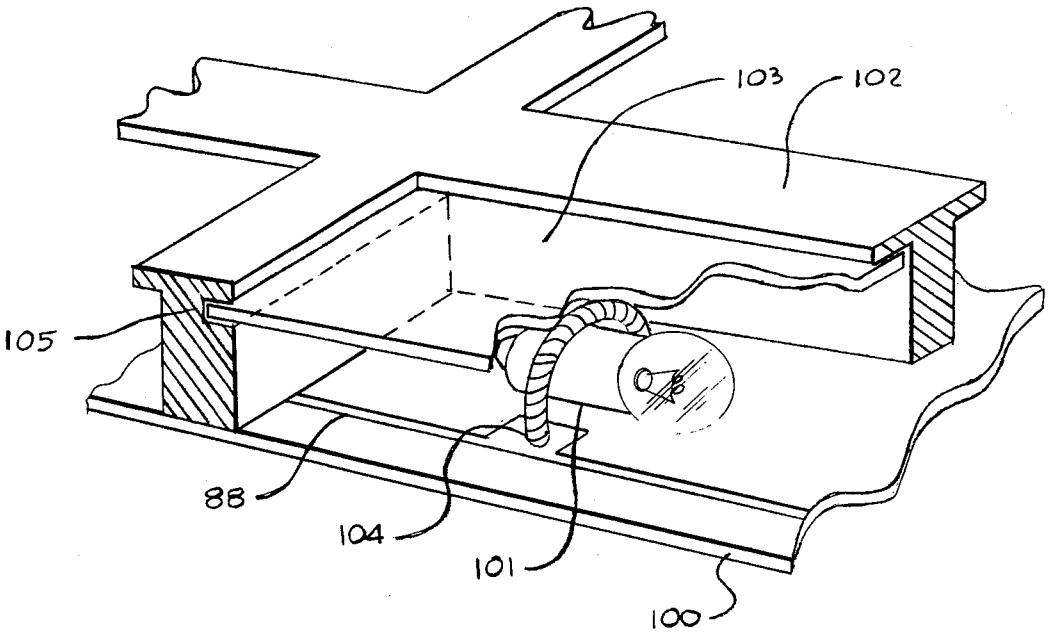
FIG. 10 is a fragmentary perspective view of switch means used in said clock.
Figure 11:
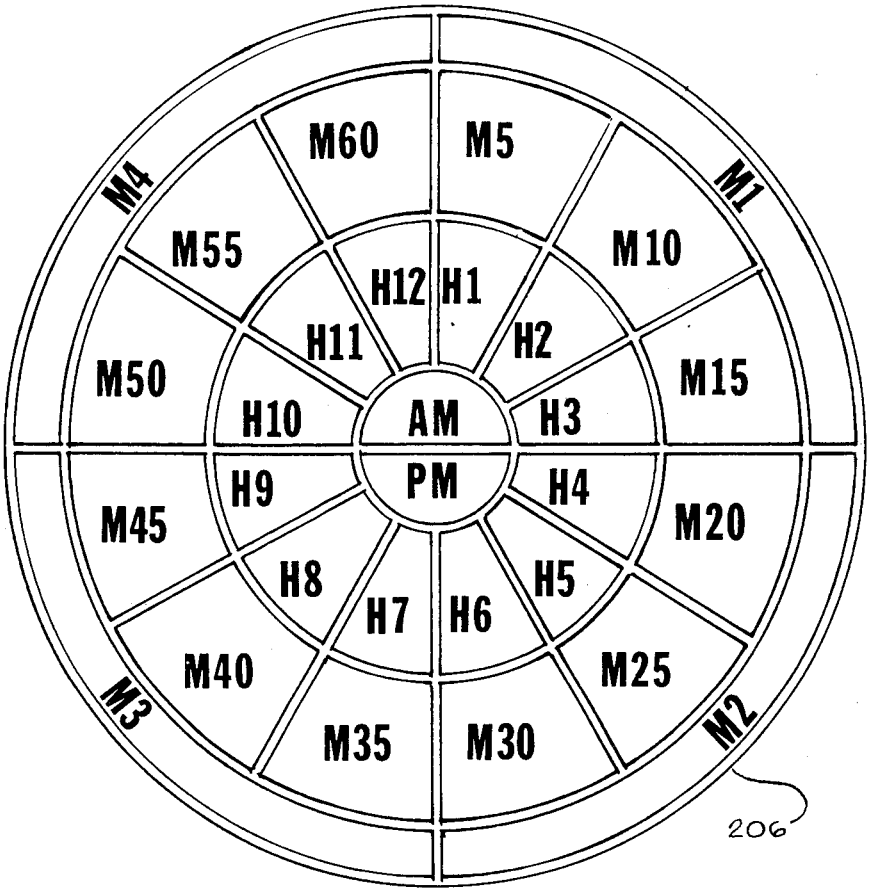
FIGS. 11 and 12 are respective front elevational views of two further embodiments of clocks according to my invention.
Figure 12:
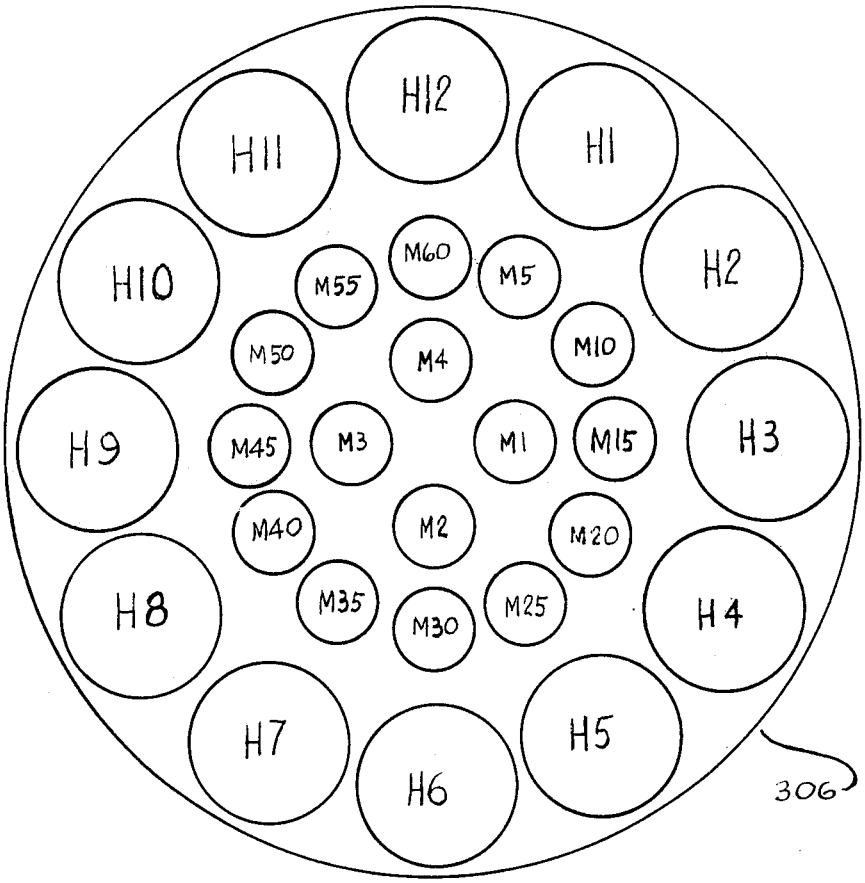

Referring to the drawings in greater detail and first to FIGS. 1–10, 106 generally designates said first embodiment which comprises transformer means 107; rectifier means 108; variable and regulated power supplies 110 and 112, respectively; a pulse generator 114; first counting means 116; second counting means 118; setting means 120; and display means 122 all included within a frame 102 holding a printed circuit board 100 and translucent windows 103. Though not shown for simplicity all of the means shown in block diagram in FIG. 2 have ground available as shown in FIG. 6 for blocks 108, 110 and 112.

Said transformer means 107 comprises a step-down transformer 150 and said rectifier means 108 comprises a full wave bridge rectifier 91 including a capacitor 92. Said transformer 150 changes the alternating current power source to a lower voltage and applies it to both said pulse generator 114 and to said bridge rectifier 91. Said variable power supply 110 comprises transistors 94 and 97; bias resistors 98 and 99; and photocell 96. Said regulated power supply 112 comprises a 5 volt regulator 93 including a capacitor 95, and feeds pulse generator 114, display means 122, first and second counting means 116 and 188, respectively, and setting means 120 as shown by line 123. Said first counting means 116 comprises divide by six counters 80 and 83, divide by 10 counters 82 and 84, and inverter 85. Said second counting means 118 comprises a divide by five counter 12, divide by 12 counters 15 and 17, a divide by two counter 19, and an inverter 21.

Said setting means comprises 35 switches 87; a setting buss 88; a comparator 89; and NAND gates 81 and 86. Said display means 122 comprises binary to decimal decoder drivers 34–38; AM and PM drivers 74 and 75, respectively; five groups of incandescent lamps 151–155; and a display power buss 76. Said comparator 89 comprises resistors 401, 402, 405 and 407, transistors 404 and 406, and diode 403. Conventional circuit components, either discrete or integrated, are employed in my invention. I have found that the SN7400 series of integrated circuit components manufactured by Texas Instrument Corporation of Dallas, Tex. to be suitable, such as SN7490 for divide by five and divide by 10 counters 12, 19, 82 and 84; SN7492 for the divide by six and divide by twelve counters 15, 17, 80 and 83; SN74121 for the one-shot device 79 and SN7445 for the BCD decoder drivers 34, 35, 36, 37, and 38.

Said rectifier 91 feeds both the variable and regulated power supplies 110 and 112, respectively. Said variable power supply 110 is applied to the display power buss 76 and has its voltage varied by the operation of said photocell 96, the resistancy of which varies as the ambient light changes. As the ambient light increases, i.e., during the day, the resistance of the photocell 96 decreases which causes a proportionate increase in the conduction of both transistors 94 and 97 which, in turn, causes said lights 151–155 to shine more brilliantly. At night time said lights 151–155 are made to shine in a more subdued manner. Minimum and maximum brilliance are determined by said resistors 98 and 99, respectively. The output of said voltage regulator 93 is applied to said first and second counting means 116 and 118, respectively, and to the drivers 34–38 and 74 and 75 of said display means 122.

Said pulse generator 114 comprises a waveshaper 78 and a one-shot device 79. Said waveshaper 78 clips the 60 cycle-per-second signals it receives from said transformer 150 and triggers said one-shot device 79 therewith. Said one-shot device 79 feeds 60 pulses per second to both the divide by six counter 80 and the NAND gate 81 while providing immunity to spurious signals because it cannot be retriggered until it times out just before receiving the next pulse from said waveshaper 78. The one-shot device 79 also provides one reset input to counters 80 and 82–84, the other reset being provided by comparator 89 during setting of the clock 106 which is described infra. The NAND gate 81 is a component of the setting means 120, the operation of which is described infra. The counter 80 applies 10 pulses per second to the divide by 10 counter 82 which applies 60 pulses per minute to divide by six counter 83, which applies 10 pulses per minute to divide by 10 counter 84. The counter 84 applies one pulse per minute to the inverter 85 which feeds NAND gate 86, which, in turn, feeds the divide by five counter 12.

The counter 12 feeds the driver 34 with 1-minute signals over the lines 23–25 for the first 4 minutes of each 5-minute period, and on the 5th minute sends a signal to the divide by 12 counter 15 and to driver 34 over line 25. Said divide by 12 counter 15 feeds drivers 35 and 36 with 5-minute signals over the lines 26–29 for the first 11 5-minute periods of each hour and on the 12th 5-minute period sends a signal to divide by 12 counter 17 and drivers 35 and 36 over the line 29. Said divide by 12 counter 17 sends signals every hour for the first 11 hours of each 12-hour period over lines 30–33 to drivers 37 and 38 and on the 12th hour sends a signal over line 33 to divide by two counter 19 and drivers 37 and 38. Said divide by two counter 19 sends a signal on each alternate 12-hour period to AM driver 74 over line 20, and on every other 12-hour period sends a signal to PM driver 75 through inverter 21 and line 22.

Figure 1:
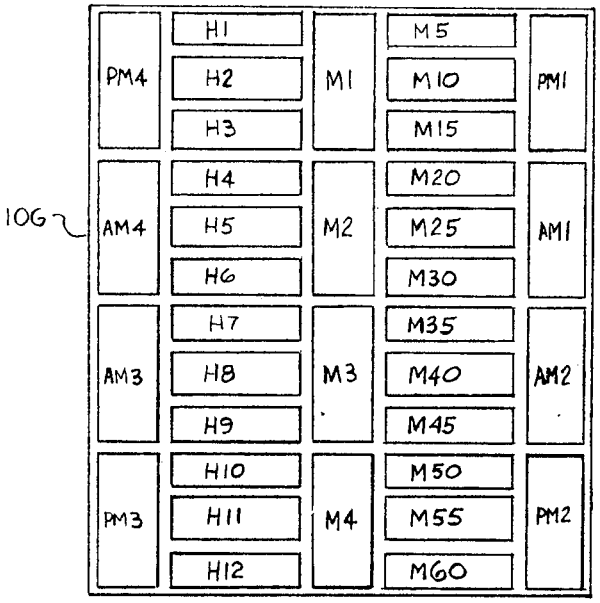
FIG. 1 is a front elevational view of a clock embodying my invention.

Decoder driver 34 controls the group of bulbs 151 to display 1-minute units of time. Likewise, decoder driver 35 and 36 control the two groups of bulbs 152 to display 5-minute units of time. Decoder drivers 37 and 38 control the two groups of bulbs 153 to display hour-units of time. AM driver 74 controls the groups of bulbs 154 to display ante meridian time. PM driver 75 controls the groups of bulbs 155 to display post meridian time. The power for all the groups of bulbs 151–155 is provided by said variable supply 110 via display power buss 76. As is standard technique for decoder/driver integrated circuits the drivers 34–38 and 74,75 pull down the respective groups of bulbs to illuminate them. The groups of lights 151–155 are mounted upon said printed circuit board 100 as are springs 104, which yieldably press outwardly upon the windows 103 while they are held in place in the frame 102. The windows 103 are indicated in FIG. 1 in accordance with their function in the clock 106, i.e., there are four AM windows designated AM1 to AM4; four PM windows designated PM1 to PM4; 4-minute windows designated M1 to M4; twelve 5-minute windows designated M5, M10, etc., to M60; 12 hour windows designated H1 to H12. The M60 window is never illuminated and is thus not used for time display purposes.

When any window 103 is manually depressed by pushing inwardly thereupon it moves in its respective slot 105, and depresses the corresponding spring 104 to contact the base 101 of the corresponding bulb. Such movement and contact of said spring 104 serves as a switch arm to carry a signal to the common setting buss 88 which is incorporated into the copper network on the printed circuit board 100. Said springs 104 act as respective switch arms of 35 switches 87 which are individually connected to lines 39–73 and are commonly connected to a common setting buss 88. When one of the 35 switches 87 is manually closed, a signal will be passed over the common setting buss 88 to the voltage comparator 89 which determines if the corresponding bulb is on or off by comparing the signal over buss 88 with that of the display power buss 76. Closing of the respective switch 87 passes a small current through corresponding bulb 151–155, and places the voltage of said display supply 76 on said common setting buss 88 which produces, via comparator 89, a signal over line 90 to reset the counters 80–84 and enable the NAND gate 81 to pass 60 pulses per second from the one-shot device 79 to gate 86 where they are passed over line 13 to said second counting means 118 which then rapidly advances and drives the display means 122 to update the same to illuminate said bulb through the corresponding driver 34–38 and 74,75. Upon release of the depressed window 103 the respective switch 87 will then open and cause the common setting buss 88 to return to its normal function as an open circuit. Upon lighting of the corresponding bulb the signal over the common setting buss 88 matches that over the display power buss 76 thereby ceasing the re-setting action of the counters 80–84 and setting of the clock 106 just described. Since, by the action of the springs 104, the windows 103 will immediately return to their normal undepressed positions upon release thereof, the particular window desired to be illuminated during manual setting of the clock 106 should be momentarily held depressed to allow for completion of the up-dating action of said second counting means 118.

When setting said clock 106 the appropriate window or windows are held depressed, whereupon the clock 106 will rapidly update the time it displays until the depressed window or windows are turned on, and at that instant the clock 106 will keep time in its normal fashion. The order of entering information commences with the most significant information first, e.g., AM or PM. The next information may be the hours. The appropriate hour window is held depressed until the display updates to that point; then the 5 minute information is entered by depressing the proper 5-minute window until it is turned on; finally minute information is entered by depressing the proper minute window until it is turned on. Since the clock 106 updates the time it displays at the rate of 1 minute every one-sixtieth of a second and resets the timing means during such updating, the clock 106 (if set to a known time standard) will be accurate, discounting human reaction time, to within one-twelfth of a second, maximum error (if first preset to a time, 5 minutes before a given time standard, and then updated to said time standard).

Figure 13:
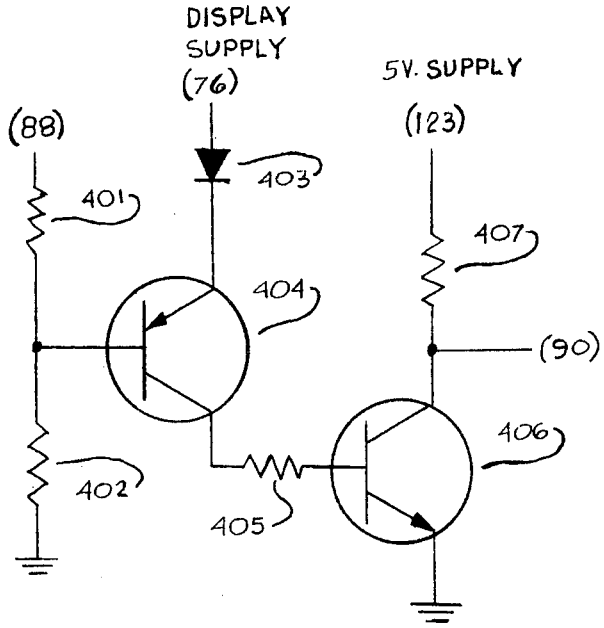
FIG. 13 is a schematic diagram of a portion of the structure of FIG. 3.
Figure 2:
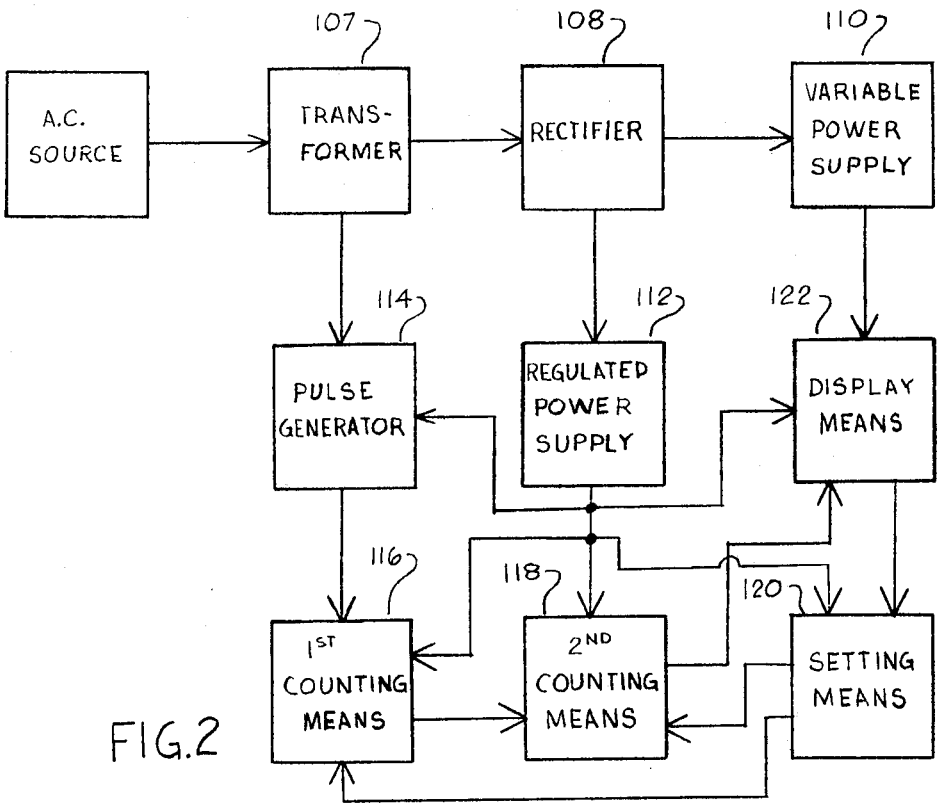
FIG. 2 is a block diagram of circuitry used in said clock.
Figure 3:
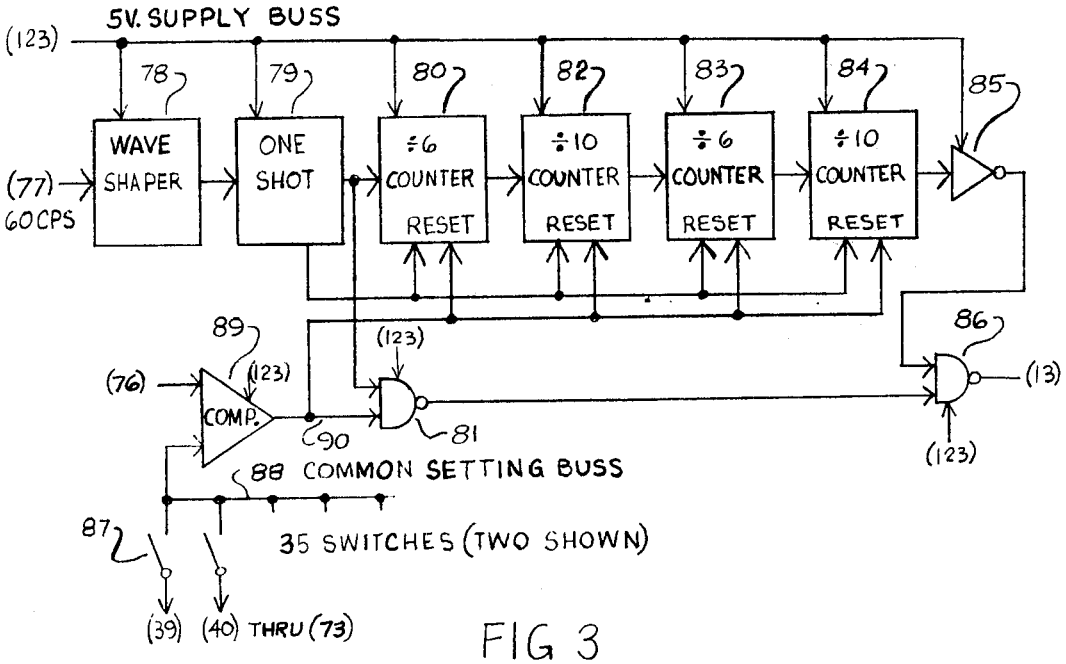
FIGS. 3–5 are block diagrams, respectively, of counting means used in said clock.
Figure 4:
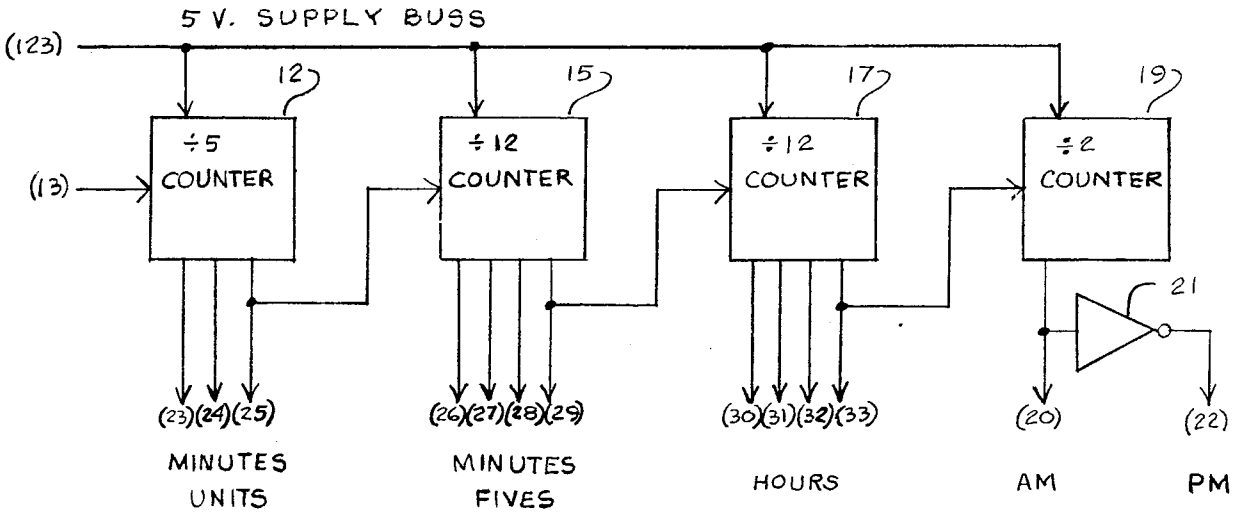
Figure 5:
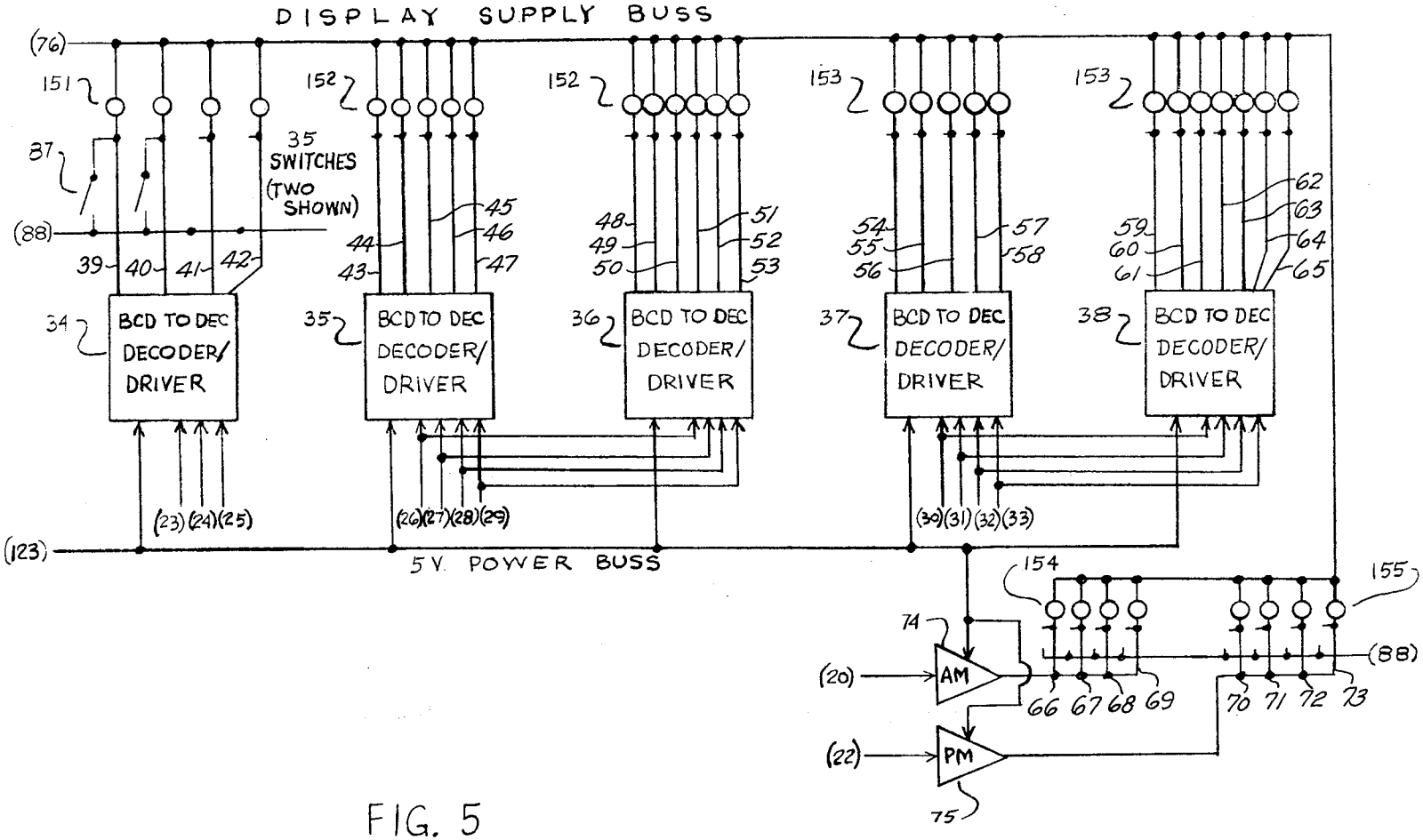

Comparator 89 which is shown in greater detail in FIG. 13 provides the other reset input to counters 80, 82, 83 and 84 during setting. This insures that it will require a full 60 seconds after setting to get a pulse through inverter 85 and through gate 86 to the output 13. If no switches 87 are activated for setting, the setting buss 88 will be an open circuit. In this case, transistor 404 conducts through resistor 402 and causes transistor 406 to conduct through resistor 405. The output signal on line 90 is thus maintained near zero volts. When a switch 87 to a bulb 151, 152, 153, 154 or 155 that is not illuminated is closed, the common setting buss 8 will become the voltage of the display supply. This voltage input 88 will cause transistor 404 to stop conducting which in turn causes transistor 405 to stop conducting and the output signal on line 90 will become near 5 volts and causes NAND gate 81 to pass a signal from the one-shot device 79 as previously described.

Clocks 206 and 306 illustrate other modifications of my invention using the same system, i.e., groups of lights and depressable translucent windows for setting the time and to display AM or PM, the 12 hours, 5-minute segments of an hour, and five 1-minute segments of a 5-minute period. The rectangularly arranged clock 106 and the two different circularly arranged clocks 206 and 306 show only a few of various styles and types of such arrangements possible.

It will thus be seen that there has been provided by my invention improvements in clocks and in method of displaying and keeping time in which the object hereinabove set forth, together with many thoroughly practical advantages, has been successfully achieved. While preferred embodiments of my invention have been shown and described, it is to be understood that variations and changes may be resorted to without departing from the spirit of my invention as defined by the appended claims.

What I claim is:

1. Improvement in a clock in which time is kept by counting the cycles of an alternating current source and having power supply means providing both alternating and direct current power, display means for displaying time including a plurality of lights and windows corresponding to said lights, said direct current power including a variable display voltage for illuminating said lights, pulse generator means for generating pulses from said alternating current source, counting means for counting and dividing the output of said pulse generator means, said display means decoding the output of said counting means and lighting said lights and windows in accordance with the time of day, said improvement comprising setting means operative upon said counting means for correcting the time displayed by said clock, said setting means including a plurality of electrical switch means corresponding to said lights, actuation of any of said switch means completing an electrical circuit to up date said counting means, comparator means for comparing, upon actuation of one of said switch means said display voltage with the voltage applied to the light whose corresponding switch means is actuated, said comparator means operative, whenever the compared voltages are unequal, to actuate said counting means to correct the time displayed by said clock.

2. Improvement in a clock in which time is kept by counting the cycles of an alternating current source and having power supply means providing both alternating and direct current power, display means for displaying time including a pluraity of lights and windows corresponding to said lights, said direct current power including a variable display voltage for illuminating said lights, pulse generator means for generating pulses from said alternating current source, counting means for counting and dividing the output of said pulse generator means, said display means decoding the output of said counting means and lighting said lights and windows in accordance with the time of day, said improvement comprising setting means operative upon said counting means for correcting the time displayed by said clock, said setting means including means for depressing said windows, a plurality of electrical switch means corresponding to said windows, depression of any of said windows closing its corresponding switch means, comparator means for comparing upon closing of one of said switch means said display voltage with the voltage applied to the light whose corresponding window is depressed, said counting means having two stages, one feeding the other, said comparator means operative, whenever the compared voltages are unequal, to re-set and by-pass the first stage while speeding up the operation of the second stage for correcting the time displayed by said clock.

3. Improvement in apparatus as claimed in claim 2, said direct current power supply means including a variable power supply for said lights which is controlled by ambient light to subdue the illumination of said windows during low levels of ambient light and to brighten said illumination during high levels of ambient light.

4. Improvement in apparatus as claimed in claim 3, said variable power supply including bias resistor means which set minimum and maximum levels for said illumination.

5. Improvement in apparatus as claimed in claim 3, said direct current power supply means also including a regulated power supply for said display means, pulse generator means, counting means and setting means.

6. Improvement in apparatus as claimed in claim 5, said comparator means having two transistor means fed respectively by said variable and regulated power supplies, a common setting buss for connecting said switch means to said comparator means, said switch means individually operative for permitting comparison of the voltage on said setting buss with that of said variable power supply.

7. Improvement in apparatus as claimed in claim 2, each said window having switch means disposed behind the same which is closed upon depression of said window, each said switch means comprising the base of one of said lights and means arranged to contact said base to effect said closing.

8. Improvement in apparatus as claimed in claim 7, said switch means including yieldable means for holding said window in a normal undepressed position and for returning said window to said normal position upon release of the depression thereof.

9. Improvement in apparatus as claimed in claim 2, there being four 1-minute and 11 5-minute windows, whereby said clock has readability to 1-minute intervals.

10. In a method of keeping time by counting the cycles of an alternating current source and providing both alternating and direct current power from said alternating current source, displaying time using a plurality of lights and windows corresponding to said lights, said direct current power including a variable display voltage for illuminating said lights, generating signals from said alternating current source, counting and dividing said signals, decoding said counted and divided signals, and lighting said lights and windows in accordance with said decoding to display the time of day, and correcting, when necessary, the time displayed by said clock, said improvement comprising providing a plurality of electrical switches corresponding to said lights, said correcting being accomplished by actuating one of said switches, completing an electrical circuit upon such actuation of said switch and comparing said display voltage with the voltage applied to the light whose corresponding switch is actuated, said comparing being operative, whenever the compared voltages are unequal, to alter said counting to correct the time displayed by said clock.

11. In a method of keeping time by counting the cycles of an alternating current source and providing both alternating and direct current power from said alternating current source, displaying time using a plurality of lights and windows corresponding to said lights, said direct current power including a variable display voltage for illuminating said lights, generating signals from said alternating current source, counting and dividing said signals, decoding said counted and divided signals and lighting said lights and windows in accordance with said decoding to display the time of day, and correcting, when necessary, the time displayed by said clock, said improvement comprising providing a plurality of electrical switches corresponding to said windows, said correcting being accomplished by depressing one of said windows, depression of any of said windows closing its corresponding switch, comparing, upon closing of one of said switches said display voltage with the voltage applied to the light whose corresponding window is depressed, said counting and dividing being accomplished in two steps, one following the other, said comparing being operative, whenever the compared voltages are unequal, to re-set and by-pass the first step while speeding up the second step.

12. Improvement in method as claimed in claim 11, providing a switch for each said window, closing said switch upon depression of said window, using the base of one of said lights as a part of said switch, said closing being accomplished by making electrical contact with said base.

13. Improvement in method as claimed in claim 12, yieldably holding said window in a normal undepressed position and returning said window to said normal position upon release of the depression thereof.

14. Improvement in method as claimed in claim 11, said direct current power including variable power for said lights, said comparing utilizing said variable power as one of said compared voltages.

* * * * *